US011396437B2

(12) United States Patent
Nitta et al.

(10) Patent No.: US 11,396,437 B2
(45) Date of Patent: Jul. 26, 2022

(54) SHEET FEEDING APPARATUS AND IMAGE FORMING APPARATUS

(71) Applicant: CANON KABUSHIKI KAISHA, Tokyo (JP)

(72) Inventors: Jumpei Nitta, Yokohama (JP); Tatsuo Nishiyama, Yokohama (JP); Atsushi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/885,123

(22) Filed: May 27, 2020

(65) Prior Publication Data

US 2020/0377324 A1 Dec. 3, 2020

(30) Foreign Application Priority Data

May 31, 2019 (JP) ..... JP2019-102859

(51) Int. Cl.

| | |
|---|---|
| ***B65H 3/52*** | (2006.01) |
| ***B65H 1/14*** | (2006.01) |
| ***B65H 1/26*** | (2006.01) |
| ***B65H 31/06*** | (2006.01) |
| ***B65H 11/02*** | (2006.01) |
| ***B65H 29/14*** | (2006.01) |

(52) U.S. Cl.
CPC ..... *B65H 31/06* (2013.01); *B65H 11/02* (2013.01); *B65H 29/14* (2013.01)

(58) Field of Classification Search
CPC ... B65H 1/14; B65H 1/04; B65H 1/08; B65H 1/10; B65H 1/266; B65H 3/5223; B65H 2405/1118; B65H 11/02
See application file for complete search history.

(56) References Cited

U.S. PATENT DOCUMENTS

2009/0189329 A1* 7/2009 Kaseda ..... B65H 1/12 271/4.1
2018/0222698 A1* 8/2018 Yoshida ..... B65H 1/266

FOREIGN PATENT DOCUMENTS

| | | | |
|---|---|---|---|
| JP | 02225222 A | * | 9/1990 |
| JP | 04298429 A | * | 10/1992 |
| JP | 2001-088967 A | | 4/2001 |
| JP | 2010-0064845 A | | 3/2010 |
| JP | 2011-131961 A | | 7/2011 |

* cited by examiner

*Primary Examiner* — Luis A Gonzalez
(74) *Attorney, Agent, or Firm* — Canon U.S.A., Inc. I.P. Division

(57) ABSTRACT

A sheet feeding apparatus includes a stacking member having a separation unit and an opening portion disposed upstream from the separation unit, a feeding member, and a moving device that includes a slope portion having a slope along which sheets are guided toward the separation unit. The moving device moves the stacking member between a first position where the feeding member and sheets stacked on the stacking member are in contact with each other, and a second position where the feeding member and the sheets are not in contact with each other. When the stacking member is at the first position, the slope portion is disposed at a position lower than the separation unit in a vertical direction. When the stacking member is at the second position, the slope portion is disposed to protrude via the opening portion to be higher than a stacking surface of the stacking member.

14 Claims, 8 Drawing Sheets

SHEET FEEDING APPARATUS AND IMAGE FORMING APPARATUS

BACKGROUND

Field

The present disclosure relates to a sheet feeding apparatus that feeds a sheet and an image forming apparatus including the sheet feeding apparatus.

Description of the Related Art

Conventionally, there is an image forming apparatus that includes a sheet feeding apparatus that feeds a sheet to an image forming unit, and an image is formed on the sheet. This type of image forming apparatus is widespread.

As the sheet feeding apparatus, there is a type of sheet feeding apparatus that includes a sheet drawer serving as a sheet storage unit. The sheet drawer is removably inserted in a main body of an image forming apparatus, and a sheet stacking board on which sheets are stacked is disposed inside the sheet drawer. The sheet stacking board is pivoted to keep the height of the stacked sheets substantially uniform, and a feeding member, such as a feeding roller, feeds a sheet to an image forming unit.

Japanese Patent Application Laid-Open No. 2010-64845 discusses a configuration in which a friction plate that comes into contact with a sheet is disposed at a sheet stacking board as a separation unit.

In Japanese Patent Application Laid-Open No. 2010-64845, a frictional force that is exerted by bringing the lowermost sheet of a sheet bundle stacked on the sheet stacking board into contact with the friction plate prevents simultaneous feeding (overlap feeding) of a plurality of sheets by the feeding member.

However, in the configuration in which the separation unit is disposed at the sheet stacking board, the following matter is raised. When a plurality of sheets (a sheet bundle) is stacked on the sheet stacking board, the sheet bundle cannot be stacked at a desired position because the sheet bundle is caught on the separation unit due to contact between the lowermost sheet of the sheet bundle and the separation unit. If the sheet bundle cannot be stacked at the desired position, a feeding error may occur during sheet feeding.

SUMMARY

The present disclosure is directed to a sheet feeding apparatus and an image forming apparatus that reliably feed a sheet even in a case where a separation unit is disposed at a sheet stacking board.

According to an aspect of the present disclosure, a sheet feeding apparatus includes a stacking member on which sheets are to be stacked, a feeding member configured to feed the sheets stacked on the stacking member, and a moving device configured to move the stacking member between a first position where the feeding member and the sheets stacked on the stacking member are in contact with each other, and a second position where the feeding member and the sheets stacked on the stacking member are not in contact with each other, wherein the stacking member includes a separation unit and an opening portion, wherein the separation unit is disposed at a position facing the feeding member and configured to separate the sheets, and the opening portion is disposed upstream from the separation unit in a sheet feeding direction of feeding by the feeding member, wherein the moving device includes a slope portion having a slope along which the sheets are guided toward the separation unit, wherein, in a state where the stacking member is at the first position, the slope portion is disposed at a position lower than the separation unit in a vertical direction, and wherein, in a state where the stacking member is at the second position, the slope portion is disposed to protrude via the opening portion to be higher than a stacking surface of the stacking member.

Further features of the present disclosure will become apparent from the following description of exemplary embodiments with reference to the attached drawings.

DESCRIPTION OF THE EMBODIMENTS

Some embodiments of the present disclosure will be described in detail below as examples, with reference to the drawings. However, characteristics such as sizes, materials, shapes, and relative positions of components to be described in each of the embodiments may be appropriately modified depending on a configuration and various conditions of an apparatus to which the present disclosure is applied. In other words, these characteristics are not intended to limit the scope of the present disclosure to the following embodiments.

[Overall Configuration]

An image forming apparatus including a sheet feeding apparatus according to a first exemplary embodiment of the present disclosure will be described with reference to FIGS. 1 to 4. An overall configuration of the image forming apparatus, a configuration of the sheet feeding apparatus, and effects of a slope portion will be described in this order. Here, as an example of the image forming apparatus, a laser beam printer will be described. In the laser beam printer, toner images of colors each on a corresponding one of photosensitive drums are sequentially transferred to a belt, and the toner images transferred on the belt are collectively transferred to a recording material.

(Overall Configuration of Image Forming Apparatus)

Figure 1:
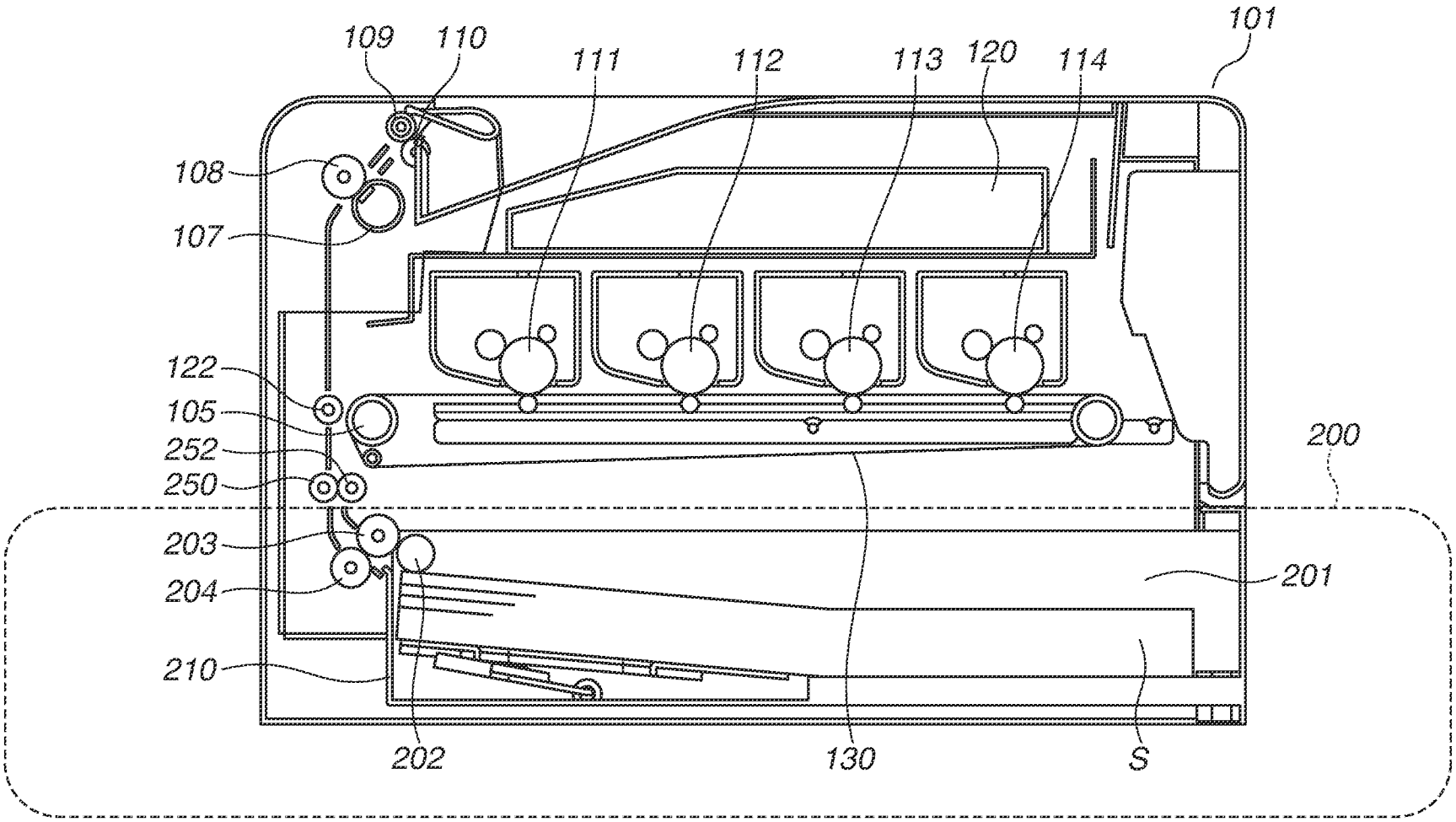
FIG. 1 is a schematic cross-sectional diagram illustrating an image forming apparatus according to a first exemplary embodiment.

An overall configuration of the image forming apparatus will be described with reference to FIG. 1. FIG. 1 is a schematic cross-sectional diagram illustrating the image forming apparatus. In the present exemplary embodiment, an image forming apparatus 101 includes a sheet feeding apparatus 200. The sheet feeding apparatus may be, for example, a feeding deck that stores a large number of sheets, as an optional apparatus that can be attached on the image forming apparatus 101.

A sheet S stored inside a sheet drawer 201 is fed by a feeding roller 202 that is a feeding member that rotates in a clockwise direction in FIG. 1. The fed sheet S is sent to a conveyance nip area which is formed by a conveyance roller 250 and a conveyance opposed roller 252. The sheet S is then sent to a transfer nip area which is formed by an in-belt roller 105 and a transfer roller 122 with an intermediate transfer belt 130 interposed between the in-belt roller 105 and the transfer roller 122.

Photosensitive drums 111, 112, 113, and 114, each of which is an image bearing member included in a corresponding one of image forming units, rotate in a counterclockwise direction in FIG. 1. In each of the image forming units, an electrostatic latent image is formed on an outer peripheral surface of the photosensitive drum by a laser beam emitted from a laser scanner 120, and the electrostatic latent image is developed by a development roller, so that a toner image is formed. The toner image formed on the photosensitive drum is primary transferred to the intermediate transfer belt 130. In a case where a color image is formed, color toner images of yellow, magenta, cyan, and black are developed on the photosensitive drums 111, 112, 113, and 114, and the toner images thus formed on the respective photosensitive drums are sequentially transferred to the intermediate transfer belt 130. Subsequently, the toner images formed on the intermediate transfer belt 130 are secondary transferred to the sheet S sent to the nip portion between the in-belt roller 105 and the transfer roller 122.

The sheet S to which the toner images have been transferred is sent to a nip portion between a fixing film 107 and a pressure roller 108, and the toner images are fixed to the sheet S by application of heat and pressure at the nip portion. The sheet S to which the toner images are fixed is discharged by discharge rollers 109 and 110.

(Configuration of Sheet Feeding Apparatus)

Figure 2:
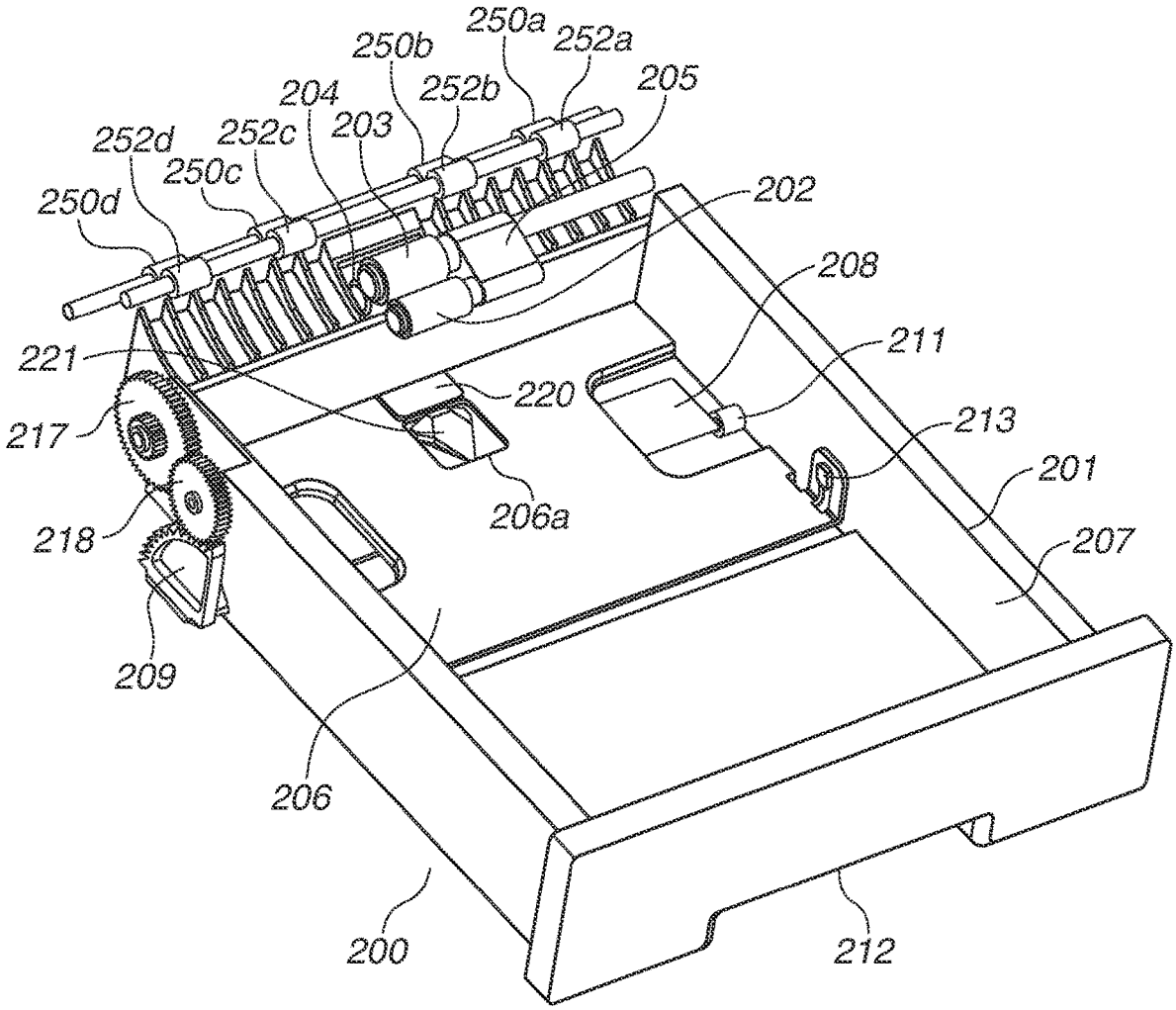
FIG. 2 is a perspective diagram illustrating a configuration of a sheet feeding apparatus according to the first exemplary embodiment.

The sheet feeding apparatus will be described with reference to FIG. 2. FIG. 2 is a perspective diagram illustrating a configuration of the sheet feeding apparatus 200.

In the sheet feeding apparatus according to the present exemplary embodiment, a system using a separation roller is employed as a sheet feeding system. The feeding roller 202 that is a feeding member is supported by a holder 205 that is a holding member. The holder 205 is vertically pivotable around the center of a feed roller 203 that is a conveyance member. The sheet drawer 201 is a storage device removably inserted in the sheet feeding apparatus 200 and capable of storing a plurality of sheets S. The sheet drawer 201 includes a sheet stacking board 206 that is a stacking member on which a plurality of sheets (a sheet bundle) can be stacked, and the sheets S are stacked on the sheet stacking board 206.

In the sheet feeding apparatus 200, the feeding roller 202 can abut on the uppermost surface of the stacked sheets S. Further, a torque limiter (not illustrated) is disposed at the central axis of a separation roller 204 that is a separation member. The feeding roller 202 and the feed roller 203 are rotated by receiving a driving force transmitted from a drive source (not illustrated).

The feeding roller 202 rotates to feed the uppermost sheet S. In a case where only one sheet S is fed by the rotation, a large rotation torque is applied to the separation roller 204 via the sheet S at a nip portion formed by the separation roller 204 and the feed roller 203, and consequently, the torque limiter disengages. Therefore, the separation roller 204 rotates by following the sheet S being conveyed. In a case where the two or more sheets S are fed by the feeding roller 202, only a frictional force between the two or more sheets S is transmitted to the separation roller 204, and consequently, the torque limiter does not disengage. As a result, the separation roller 204 does not rotate. Accordingly, the sheet(s) S except for the sheet S on the feed roller 203 side is stopped. In this way, the separation roller 204 can reliably separate and feed the sheets S one by one.

The sheet drawer 201 includes a drawer frame 207, and the sheet stacking board 206 that is a pivotable support member attached to the drawer frame 207 to support the sheets S. The sheet drawer 201 further includes a lift arm 208 that pivots the sheet stacking board 206. The sheet drawer 201 is inserted into the image forming apparatus 101 from the front side of the image forming apparatus 101.

The sheet stacking board 206 is supported by the drawer frame 207 to be pivotable around a pivot shaft 213. The lift arm 208 that is a pivot member that pivots the sheet stacking board 206 is supported by the drawer frame 207 and pivots around a lift arm bearing 211. One end of the lift arm 208 is engaged with the lift arm bearing 211, and the other end is fixed to a lift arm drive gear 209. Here, the lift arm 208 and the lift arm bearing 211 form a moving device that moves the sheet stacking board 206.

An interface gear 218 disposed on the sheet drawer 201 is in engagement with the lift arm drive gear 209. Inserting the sheet drawer 201 into a main body of the image forming apparatus 101 causes the interface gear 218 on the sheet drawer 201 to come into engagement with an interface gear 217 on the apparatus main body, which brings a drive system into an engagement state. In this state, the lift arm 208 pivots around the lift arm bearing 211 by receiving a driving force transmitted from a drive source (not illustrated) disposed inside the main body of the image forming apparatus 101, and consequently, the sheet stacking board 206 is pivoted to a position for allowing the uppermost surface of the sheets S to be fed. Here, when the sheet stacking board 206 is at a position where the sheets S stacked on the sheet stacking board 206 and the feeding roller 202 are in contact with each other, this position is referred to as a first position. Further, when the sheet stacking board 206 is at a position where the sheets S stacked on the sheet stacking board 206 and the feeding roller 202 are not in contact with each other, this position is referred to as a second position.

A plurality of conveyance rollers 250 and a plurality of conveyance opposed rollers 252 are disposed in a sheet width direction that is a direction intersecting a sheet conveyance direction as illustrated in FIG. 2. Specifically, the conveyance rollers 250 are a conveyance roller 250*a*, a conveyance roller 250*b*, a conveyance roller 250*c*, and a conveyance roller 250*d*. The conveyance opposed rollers 252 are a conveyance opposed roller 252*a*, a conveyance opposed roller 252*b*, a conveyance opposed roller 252*c*, and a conveyance opposed roller 252*d*.

The sheet drawer 201 includes a drawer grip 212 that is a gripping portion that can be gripped by a user. When the user holds and draws the drawer grip 212 in a frontward direction of the main body of the image forming apparatus 101, the interface gear 218 on the drawer frame 207 and the interface gear 217 on the apparatus main body are released from engagement. As a result, the sheet stacking board 206 falls to the lower end. In the present exemplary embodiment, the second position is a position where the sheet stacking board 206 is at the lower end in a vertical direction (a substantially vertical direction that is substantially orthogonal to a horizontal direction). Then, the user further draws the sheet drawer 201 to the outside of the main body of the image forming apparatus 101, and can stack the sheets S.

The sheet drawer 201 includes a separation pad 220 that is a separation unit, on the sheet stacking board 206. The separation pad 220 is disposed on the downstream-end side of the sheet stacking board 206. The sheet drawer 201 further includes a slope portion 221 at a position immediately upstream from the separation pad 220. The slope portion 221 is disposed at the lift arm 208.

Figure 3:
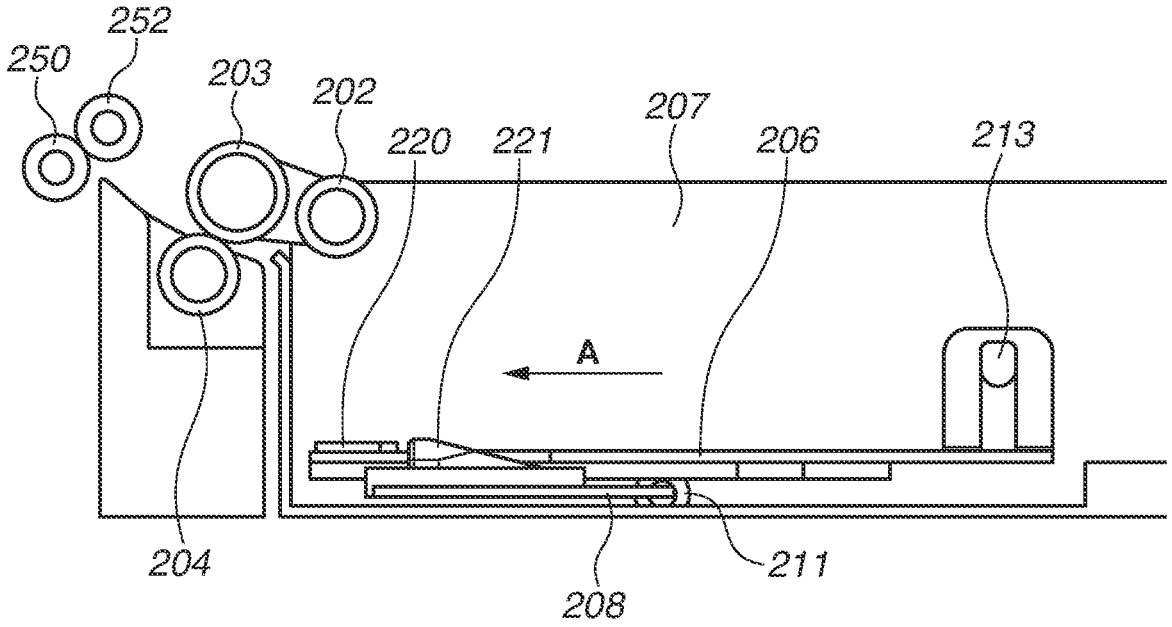
FIG. 3 is a cross-sectional diagram illustrating a configuration of the sheet feeding apparatus according to the first exemplary embodiment.
Figure 4:
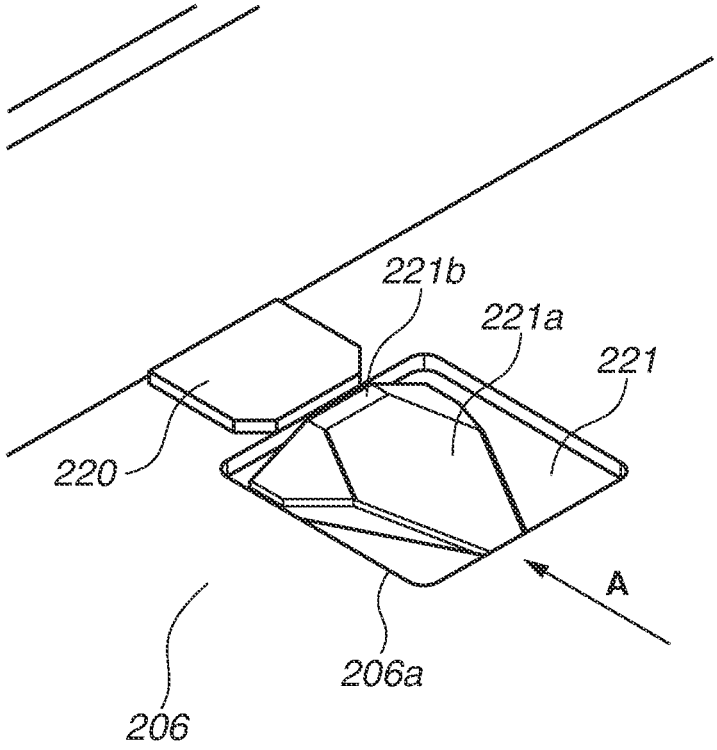
FIG. 4 is an enlarged diagram illustrating a part including a slope of the sheet feeding apparatus according to the first exemplary embodiment.

The slope portion 221 will be described with reference to FIGS. 3 to 5. FIG. 3 is a cross-sectional diagram illustrating the sheet drawer 201 in a state where the sheet stacking board 206 is at the second position. FIG. 4 is an enlarged perspective diagram illustrating a part including the slope portion 221. The separation pad 220 is disposed at a position facing the feeding roller 202, and protrudes to be higher than a sheet stacking surface of the sheet stacking board 206. The sheet stacking board 206 has an opening portion 206*a*. The slope portion 221 disposed at the lift arm 208 protrudes to be higher than the sheet stacking surface, via the opening portion 206*a*. The slope portion 221 and the separation pad 220 are in such a relationship that the apex of the slope portion 221 is at a position higher than the separation pad 220 in a height direction.

An inclined surface 221*a* and atop surface 221*b* of the slope portion 221 protrude from the opening portion 206*a* of the sheet stacking board 206. Further, the top surface 221*b* is at a position higher than the top surface of the separation pad 220 in the substantially vertical direction. The inclined surface 221*a* (a slope) is configured (used) to gradually rise from the upstream side to the downstream side in a sheet insertion direction A to guide a sheet inserted in the sheet insertion direction A to the separation pad 220.

When the sheet S is inserted in the sheet insertion direction A from the front side of the main body of the image forming apparatus 101, the leading edge of the sheet S is guided to the top surface of the separation pad 220 by the inclined surface 221*a* and the top surface 221*b*, without being caught on the separation pad 220. Therefore, during stacking of a sheet bundle on the sheet stacking board 206, the sheet bundle can be prevented from being caught on the separation pad 220, which occurs when the lowermost sheet of the sheet bundle and the separation pad 220 are brought into contact with each other, and therefore the sheet bundle can be stacked at a desired position.

Figure 5:
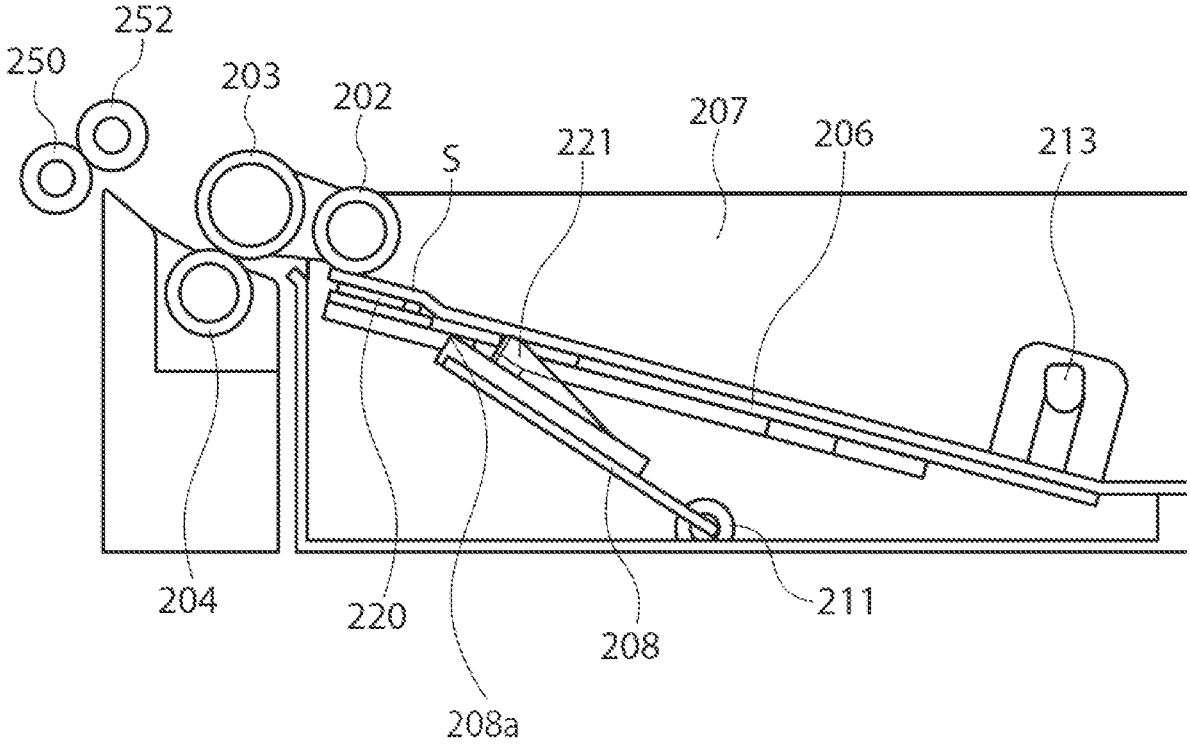
FIG. 5 is a cross-sectional diagram illustrating a configuration of the sheet feeding apparatus according to the first exemplary embodiment.

FIG. 5 is a diagram illustrating a state where the sheet stacking board 206 is pivoted by the lift arm 208 to the position for allowing the sheet S to be fed. As illustrated in FIG. 5, the slope portion 221 is between a pressing portion of the lift arm 208 and the lift arm bearing 211. The sheet stacking board 206 is at the first position while being supported by the pressing portion pressing the sheet stacking board 206. At the first position, the top surface 221*b* of the slope portion 221 does not protrude to be higher than the sheet stacking board 206, and in the present exemplary embodiment, the top surface 221*b* of the slope portion 221 is inside the opening portion 206*a*.

In other words, the slope portion 221 is at a position lower than the top surface of the separation pad 220 in the substantially vertical direction. As a result, the lowermost sheet S of the stacked sheets S is reliably in contact with the separation pad 220, and therefore overlap feeding can be prevented by a frictional force of the separation pad 220.

If the slope portion 221 is disposed at the sheet stacking board 206, the lowermost sheet S can be raised by the slope portion 221. This leads to unstable contact between the lowermost sheet S and the separation pad 220, and consequently, overlap feeding of sheets may occur.

As described above, according to the present exemplary embodiment, the leading edge of the sheet S is not caught on the separation pad 220 when the sheet S is inserted into the sheet drawer 201. The leading edge of the sheet S can be therefore prevented from being caught, and the sheet S can be smoothly inserted.

Further, in the state where the sheet stacking board 206 is pivoted by the lift arm 208 to the position for allowing the sheet S to be fed, the slope portion 221 retracts from the top surface of the separation pad 220 in the substantially vertical direction. As a result, the lowermost sheet S can be reliably brought into contact with the separation pad 220 without coming into contact with the slope portion 221, and therefore overlap feeding can be prevented.

In the present exemplary embodiment, the lift arm 208 is provided with the slope portion 221 as a separate component. However, the present disclosure is not limited to such a configuration, and is also applicable to a configuration in which a slope shape is directly formed on the lift arm 208.

In the first exemplary embodiment, the slope portion 221 is fixed to the lift arm 208. In a second exemplary embodiment, a slope portion is provided at a lift arm and supported to be slidable with respect to a sheet stacking board. Configurations similar to those of the first exemplary embodiment will be provided with the same reference numerals as those of the first exemplary embodiment and described.

Figure 6:
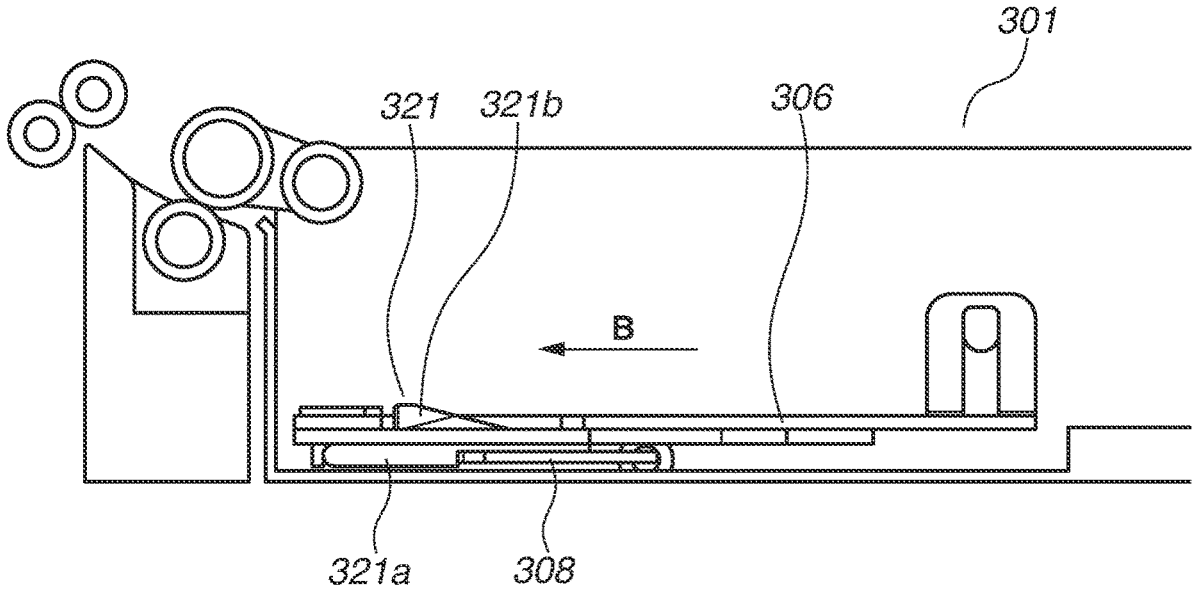
FIG. 6 is a cross-sectional diagram illustrating a configuration of a sheet feeding apparatus according to a second exemplary embodiment.
Figure 7A:
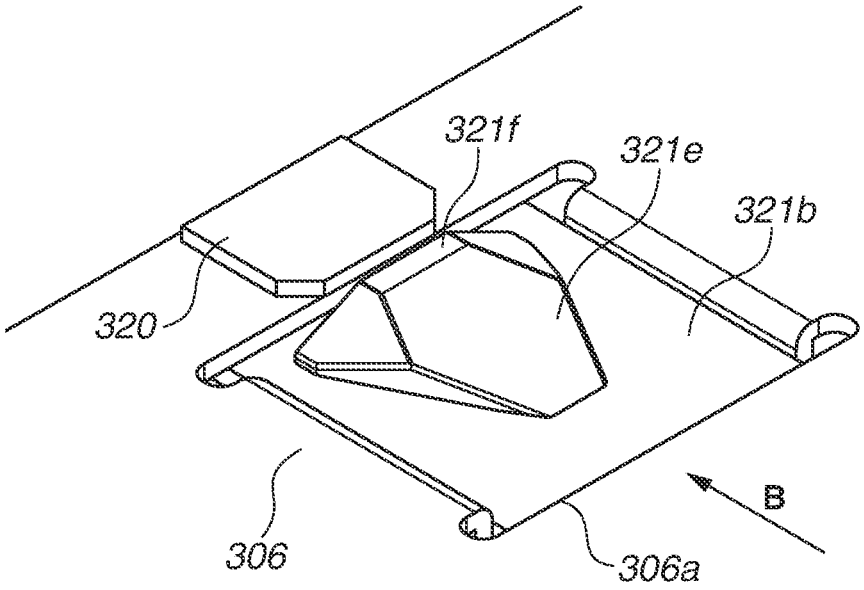
FIG. 7A is an enlarged diagram illustrating a part including a slope of the sheet feeding apparatus according to the second exemplary embodiment.
Figure 7B:
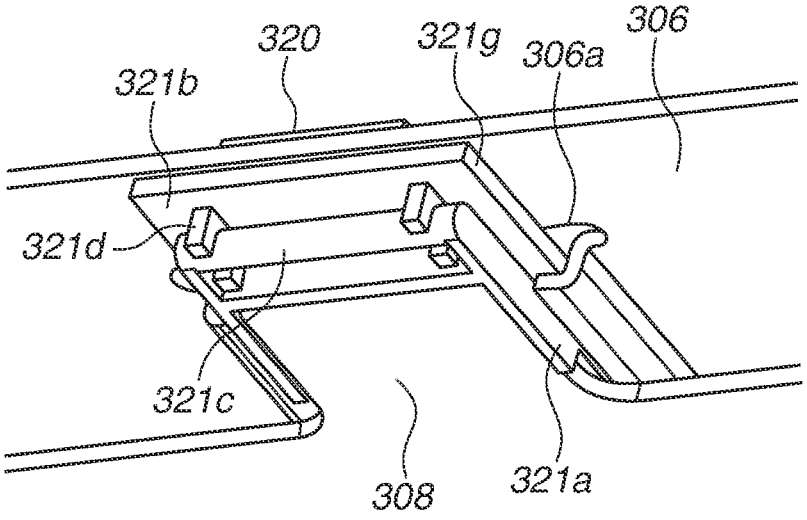
FIG. 7B is an enlarged diagram illustrating the part including the slope of the sheet feeding apparatus according to the second exemplary embodiment as viewed from the back side.

An image forming apparatus including a sheet feeding apparatus according to the second exemplary embodiment will be described with reference to FIGS. 6 to 8. FIG. 6 is a diagram illustrating a state where a sheet drawer 301 is drawn to the outside of the main body of an image forming apparatus 101, and the sheet stacking board 306 is lowered to the lower end without being pivoted (a second position). FIG. 7A is an enlarged diagram illustrating a part including a slope portion 321, and FIG. 7B is an enlarged diagram illustrating the part in FIG. 7A, as viewed from the back side of the main body.

The slope portion 321 includes a fixed portion 321*a* and an inclined portion 321*b*. The fixed portion 321*a* is fixed to a lift arm 308, and the inclined portion 321*b* is disposed to be pivotable around a pivot shaft 321*c*, with respect to a bearing 321*d*. The inclined portion 321*b* includes an inclined surface 321*e*, a top surface 321*f*, and a slide portion 321*g*, and is supported to be slidable with respect to an opening portion 306*a* of the sheet stacking board 306 by the slide portion 321*g*.

A separation unit 320 is disposed at a position facing a feeding roller 302 of the sheet stacking board 306, and has a convex shape to be higher than a sheet stacking surface. The slope portion 321 is disposed at the lift arm 308. The inclined surface 321*e* and the top surface 321*f* of the slope portion 321 protrude from the opening portion 306*a* of the sheet stacking board 306, and further, the top surface 32 if is at a position higher than the top surface of the separation unit 320 in a substantially vertical direction. When a sheet S is inserted from the front side of the main body of the image forming apparatus 101 in an arrow-B direction, the leading edge of the sheet S is guided to the top surface of the separation unit 320 by the inclined surface 321*e* and the top surface 321*f*, without being caught on the separation unit 320.

Figure 8:
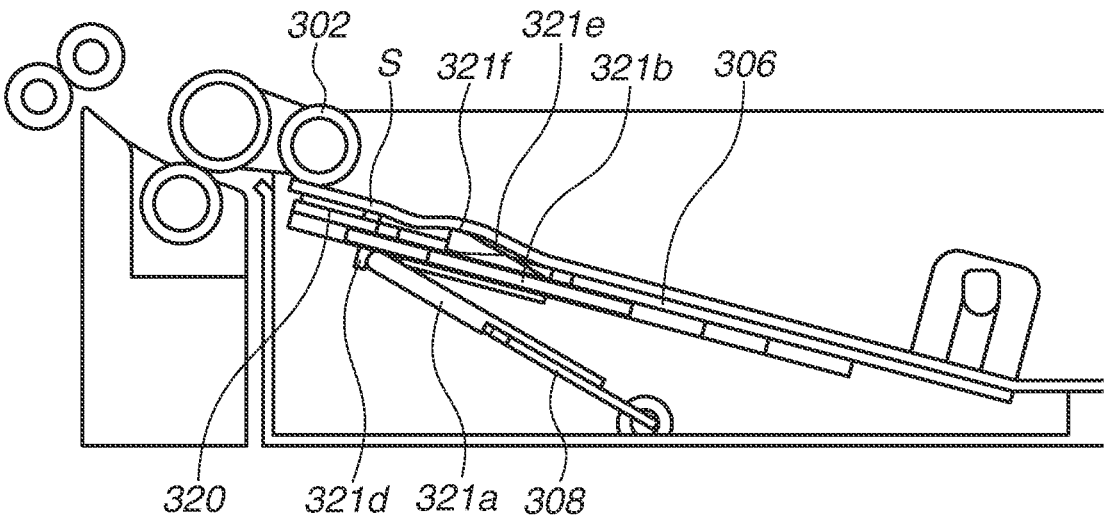
FIG. 8 is a cross-sectional diagram illustrating a configuration of the sheet feeding apparatus according to the second exemplary embodiment.

FIG. 8 is a diagram illustrating a state where the sheet stacking board 306 is pivoted by the lift arm 308 to a position for allowing the sheet S to be fed (a first position). The slope portion 321 slides toward the upstream side in a feeding direction, in the opening portion 306*a*. The top surface 321*f* of the slope portion 321 which has moved toward the upstream side in the feeding direction is at a position lower than the top surface of the separation unit 320 in the substantially vertical direction. Accordingly, the lowermost sheet S of the stacked sheets S easily comes in contact with the separation unit 320, and therefore occurrence of overlap feeding can be prevented by a frictional force of the separation unit 320.

As described above, according to the present exemplary embodiment, as with the first exemplary embodiment, the leading edge of the sheet S is not caught on the separation unit 320 when the sheet S is inserted into the sheet drawer 301. Therefore, the leading edge of the sheet S can be prevented from being caught, and the sheet S can be smoothly inserted. Further, in the state where the sheet stacking board 306 is pivoted by the lift arm 308 to the position for allowing the sheet S to be fed, the slope portion 321 retracts from the top surface of the separation unit 320 in the substantially vertical direction. As a result, the lowermost sheet S can be reliably brought in contact with the separation unit 320, and therefore overlap feeding can be prevented.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-102859, filed May 31, 2019, which is hereby incorporated by reference herein in its entirety.

What is claimed is:

1. A sheet feeding apparatus comprising:

a stacking member on which sheets are to be stacked;

a feeding member configured to feed the sheets stacked on the stacking member; and a moving device configured to move the stacking member between a first position where the feeding member and the sheets stacked on the stacking member are in contact with each other, and a second position where the feeding member and the sheets stacked on the stacking member are not in contact with each other, wherein the stacking member includes a separation unit and an opening portion, wherein the separation unit is disposed at a position facing the feeding member and configured to separate the sheets, and the opening portion is disposed upstream from the separation unit in a sheet feeding direction of feeding by the feeding member, wherein the moving device includes a slope portion having a slope along which the sheets are guided toward the separation unit, wherein, in a case that the moving device moves from the second position to the first position, the slope portion moves upward, and wherein, in a state where the stacking member is at the second position, the slope portion is disposed to protrude via the opening portion to be higher than a stacking surface of the stacking member.

2. The sheet feeding apparatus according to claim 1, wherein, in a state where the stacking member is at the first position, the slope portion is disposed at a position lower than the separation unit in a vertical direction, and wherein the second position is a position where the stacking member is at a lower end in the vertical direction.

3. The sheet feeding apparatus according to claim 1, wherein, in a case where the stacking member is at the first position, a top surface of the slope portion is at a position lower than the separation unit in a vertical direction, and wherein, in a case where the stacking member is at the second position, the top surface of the slope portion is at a position higher than a position of a top surface of the separation unit in the vertical direction.

4. The sheet feeding apparatus according to claim 1, wherein the stacking member is configured to pivot around a pivot shaft disposed on upstream side in the sheet feeding direction.

5. The sheet feeding apparatus according to claim 4, wherein the separation unit is disposed on downstream-end side of the stacking member in the sheet feeding direction.

6. The sheet feeding apparatus according to claim 5, wherein the moving device includes a pressing portion configured to press the stacking member, and the slope portion is disposed upstream from the pressing portion in the sheet feeding direction.

7. The sheet feeding apparatus according to claim 1, wherein a frictional force to be exerted between the separation unit and the sheets is greater than a frictional force to be exerted between the sheets.

8. An image forming apparatus comprising:

a stacking member on which sheets are to be stacked;

a feeding member configured to feed the sheets stacked on the stacking member;

an image forming unit configured to form an image on a sheet fed by the feeding member: and a moving device configured to move the stacking member between a first position where the feeding member and the sheets stacked on the stacking member are in contact with each other, and a second position where the feeding member and the sheets stacked on the stacking member are not in contact with each other, wherein the stacking member includes a separation unit and an opening portion, wherein the separation unit is disposed at a position facing the feeding member and configured to separate the sheets, and the opening portion is disposed upstream from the separation unit in a sheet feeding direction of feeding by the feeding member, wherein the moving device includes a slope portion having a slope along which the sheets are guided toward the separation unit, wherein, in a case that the moving device moves from the second position to the first position, the slope portion moves upward, and wherein, in a state where the stacking member is at the second position, the slope portion is disposed to protrude via the opening portion to be higher than a stacking surface of the stacking member.

9. The image forming apparatus according to claim 8, wherein, in a state where the stacking member is at the first position, the slope portion is disposed at a position lower than the separation unit in a vertical direction, and wherein the second position is a position where the stacking member is at a lower end in the vertical direction.

10. The image forming apparatus according to claim 8, wherein, in a case where the stacking member is at the first position, a top surface of the slope portion is at a position lower than the separation unit in a vertical direction, and wherein, in a case where the stacking member is at the second position, the top surface of the slope portion is at a position higher than a position of a top surface of the separation unit in the vertical direction.

11. The image forming apparatus according to claim 8, wherein the stacking member is configured to pivot around a pivot shaft disposed on upstream side in the sheet feeding direction.

12. The image forming apparatus according to claim 11, wherein the separation unit is disposed on downstream-end side of the stacking member in the sheet feeding direction.

13. The image forming apparatus according to claim 12, wherein the moving device includes a pressing portion configured to press the stacking member, and the slope portion is disposed upstream from the pressing portion in the sheet feeding direction.

14. The image forming apparatus according to claim 8, wherein a frictional force to be exerted between the separation unit and the sheets is greater than a frictional force to be exerted between the sheets.

* * * * *